US008024952B2

(12) United States Patent
Hossler et al.

(10) Patent No.: US 8,024,952 B2
(45) Date of Patent: Sep. 27, 2011

(54) SLIDE WITH SEGMENTED TOOLING HELD CLOSED BY STATIONARY REMOTE SPRING

(75) Inventors: Todd Hossler, Tiffin, OH (US); Michael W. Rindfuss, Tiffin, OH (US)

(73) Assignee: National Machinery LLC, Tiffin, OH (US)

( * ) Notice: Subject to any disclaimer, the term of this patent is extended or adjusted under 35 U.S.C. 154(b) by 793 days.

(21) Appl. No.: 12/055,452

(22) Filed: Mar. 26, 2008

(65) Prior Publication Data

US 2009/0241633 A1 Oct. 1, 2009

(51) Int. Cl.
*B21J 13/00* (2006.01)

(52) U.S. Cl. ..... 72/354.8; 72/405.01; 72/465.1; 72/482.6

(58) Field of Classification Search ..... 72/344, 72/345, 352, 356, 404, 405.01, 354.8, 465.1, 72/466.9, 433, 434, 482.6
See application file for complete search history.

(56) References Cited

U.S. PATENT DOCUMENTS 3,120,769 A 2/1964 Fritz
3,188,849 A 6/1965 Wisebaker et al.
3,855,836 A * 12/1974 Takahashi et al. ..... 62/217
5,379,625 A * 1/1995 Hale ..... 72/318
6,658,913 B1 * 12/2003 Zanzerl et al. ..... 72/482.2
7,011,019 B2 * 3/2006 Schulte ..... 100/281
2005/0061052 A1 * 3/2005 Schrock et al. ..... 72/402

OTHER PUBLICATIONS

European Search Report dated Jul. 17, 2009 of corresponding Application No. EP 09250859.7, filed Sep. 30, 2009.

* cited by examiner

*Primary Examiner* — Edward Tolan
*Assistant Examiner* — Matthew G Katcoff
(74) *Attorney, Agent, or Firm* — Pearne & Gordon LLP

(57) ABSTRACT

In a multi-station forging machine having a stationary die breast and a reciprocating slide moveable in a direction towards and away from the die breast, the slide carrying a tool holder at a workstation, a tool case moveable back and forth on the tool holder in the direction of slide movement, tool segments carried in the tool case and moveable between open and closed positions, a pivotal lever carried on the slide having one portion engaging a rearwardly facing surface adjacent a rear of the tool case, a pivot surface around which said lever pivots, and another portion on a part of the lever extending from the pivot surface remote from the one portion, a high force spring mounted on the die breast, the spring being arranged to apply a high biasing force to said other lever portion when the slide is near or at front dead center, the lever transferring said biasing force to said tool case to bias said tool case forwardly.

9 Claims, 2 Drawing Sheets

SLIDE WITH SEGMENTED TOOLING HELD CLOSED BY STATIONARY REMOTE SPRING

BACKGROUND OF THE INVENTION

The invention relates to forging machines and, in particular, to an arrangement for improving the performance of segmented radially moveable tooling on such machines.

PRIOR ART

Multi-station forging machines have demonstrated their ability to mass produce parts of complex shape in an economical manner. In using a progressive forging process to produce a complex part from round wire, there is frequently a need to create an hourglass shape, i.e. two bulbous zones longitudinally spaced by an intermediate zone narrower than each bulbous zone. To control the shape of the part, it is customary to use segmented tooling that can close on the narrow zone and open sufficiently to allow longitudinal passage of one of the bulbous zones. A problem often encountered with segmented tooling is that the pressure forces on the segments in the forging process, urges them to separate and, in turn, they push back on those elements intended to constrain them in a closed or constricted position. The pressure forces involved in the forging action can exceed the ability of the constraining elements and the segments can open slightly in the forging blow. When this happens, the precision of the part shape degrades, unwanted and detrimental material flash can occur between the segments and tooling wear can be accelerated. Conventionally, the segments are confined in the tapered bore of a sliding die case and the die case is spring-biased in a direction that resists opening of the segments. Traditionally, springs have been situated behind the sliding case. Ordinary springs, even when they are several in number and distributed around the die center, provide a relatively small force that can be inadequate to resist the reaction forces occurring in the sliding surfaces of the tooling. One approach to solve this problem has been to use a larger machine where more room is available for larger springs. A relatively recent approach to increase the biasing force on the die case has been to mount a gas spring on the die breast below the die station in question and transmit the spring force through a lever that multiplies the spring force.

In the forging of some complex parts, it is necessary or desirable to employ sliding, segmented tools on the slide or ram. This application of such segmented tooling faces the same challenge of biasing the tool case with sufficient force to prevent reverse movement of the case and consequent opening of the segments. In general, the space available around the tool case on the slide severely limits the hardware, apart from the regular tooling, and related appurtenances, that can be mounted on the slide. This lack of room makes it difficult to utilize large conventional springs. Moreover, there typically is insufficient room to mount a gas spring or structurally adequate supporting bracketry as well as a lever at a typical work station on the slide. Additionally, it is desirable to minimize the mass being reciprocated on the slide. Still further, where a gas spring requires liquid cooling, the supply of such coolant to a reciprocating slide is problematic.

SUMMARY OF THE INVENTION

The invention represents an advance in forging technology by providing a novel arrangement for producing a high biasing force on a sliding segment tool case on the slide. The high level of force obtained by the invention achieves significant improvement in part shape and dimensional uniformity through essentially complete constraint of the tool segments. The invention produces a spring bias force on a sliding case carried on the reciprocating slide from a spring fixed on the die breast. The disclosed novel arrangement avoids problems such as spring size limitations because of physical interference, added reciprocating mass, and complicated, failure prone liquid coolant circuitry which would otherwise exist were the spring mounted on the slide.

More specifically, the biasing spring is in the form of a nitrogen gas spring mounted with its axis parallel to the slide motion. A pivotal lever is mounted on the slide in a location aligned with the axis of the spring so that near the end of the forward stroke of the slide, one end of the lever is operatively pressed upon by the spring. When this end of the lever is pressed by the spring, the opposite end of the lever biases the tool segment case in a forward direction to tightly hold the segments in their closed position. The disclosed arrangement with the spring in a stationary position on the die breast has this componentry occupying an available, convenient space in the machine that does not unduly restrict its size. Moreover, the spring and lever can be strategically positioned so that the reaction forces necessary to support them during a forming blow are borne by the die breast plate and the slide tool mounting plate without requiring bracketry strong enough, and correspondingly bulky, to carry the full spring force. Where, preferably, the spring is a gas spring such as a liquid cooled nitrogen gas spring, the fixed position of the spring relative to the machine frame avoids the need for flexible lines that would otherwise be required where the spring was carried on the reciprocating slide.

DESCRIPTION OF THE PREFERRED EMBODIMENT

Figure 1:
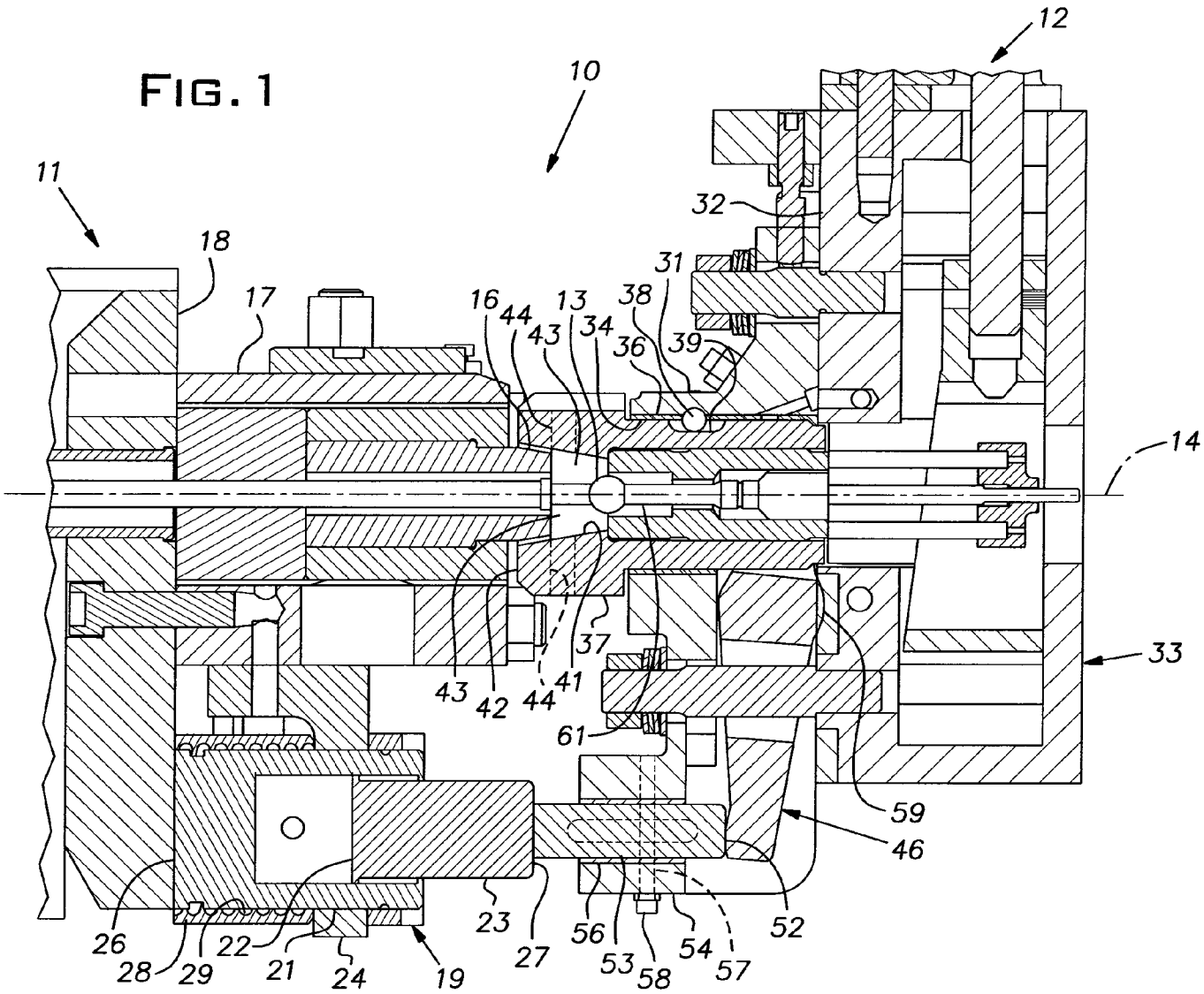
FIG. 1 is a vertical cross-sectional view through the center of a workstation of a multi-station progressive forging machine in a plane parallel to the direction of slide movement.

Referring now to FIG. 1, there is partially shown in vertical cross-section, a multi-station progressive cold forming or forging machine 10 having at the left a stationary die breast 11, and at the right a reciprocating slide or ram 12. The overall arrangement of the machine 10 is generally conventional and reference to U.S. Pat. No. 4,898,017 can be made for the general organizational details of the machine frame and drive, the disclosure of which is incorporated herein by reference.

FIG. 1 represents a station in the machine in which a part is being progressively formed and it is desired to form the part with segmented tooling mounted on the slide 12 so that an hourglass-shaped area is made on a work piece or part 13. A center line of the die and punch elements is indicated at 14.

A die 16 is assembled in a die block 17 carried on a breast plate 18. Hanging directly below the die 16 is a high force compression spring 19 in the form of a nitrogen gas spring of a commercially available type. The gas spring comprises a cylinder 21 and a piston 22 with a piston rod 23 extending out of the cylinder 21. Preferably, the central axis of the spring 19 is parallel to and directly vertically in line with the center line 14 of the die and punch. The spring 19 is supported vertically and laterally with respect to its horizontal axis in a bracket 24 having a bore that closely fits the outside diameter of the cylinder 21. A rear or bottom end 26 of the cylinder 21 is axially supported, preferably through direct abutment, with the breast plate 18. A forward end 27 of the piston rod 23 presents a flat vertical surface. The spring cylinder 21 rearward of the bracket 24 is encased in a cylindrical shell 28. The interior of the shell 28 is formed with a continuous helical groove 29. Ends of the shell 28 are sealed in a liquid-tight manner on the outside surface of the cylinder 21. Liquid coolant/lubricant, such as circulated in other parts of the machine 10 is conducted through the groove 29 so that it is in contact with the outer surface of the cylinder 21 and is thereby enabled to draw heat from the spring 19 produced by cyclical compression of the spring during operation of the machine 10 as discussed below.

In FIG. 1, the slide 12 is shown in the front dead center position, and it will be understood that the slide will move to the right when it retracts. A tool holder 31 is bolted to the front plate 32 of a wedge housing 33 representing the forward-most portion of the slide 12.

A cylindrical bore 34 in the tool holder 31, has its axis centered on the workstation axis 14 and is lined with a cylindrical bushing 36. A tool case 37 is assembled in the bushing 36 and is proportioned to slide axially within the bushing. A cross pin 38 received in a tangential slot 39 on the tool case 37 prevents the case from rotating while allowing limited axial motion within the holder 31. At its forward end, the tool case 37 has a conical bore 41 centered on its axis and narrowing with increasing distance from an end face 42. A plurality of arcuate tool segments 43, typically three or four in number, are disposed in the conical bore 41. Radially oriented pins 44, one for each segment 43, and retained in the tool case 37, operate in a slot of the respective segment 43 to control positioning of the respective segment. As understood by those skilled in the art, when the segments 43 are radially closed, they collectively create a space that precisely defines the desired shape of the section of a part 13 to be formed at the illustrated work station. Adjacent radially oriented faces of the segments 43 are in full abutting contact when the segments are in a closed position. When the segments 43 are closed, their collective outer peripheral shape is preferably fully complementary to the shape of the tapered or conical bore 41 and, apart from slots associated with the pins 44, is in full contact with the bore. When the slide 12 retracts from the front dead center position illustrated in FIG. 1, the segments 43 can move to the left in the tool case 37. In this leftward position in the tool case 37, the segments 43 are open in the sense that they have also moved radially outwardly from the position illustrated in FIG. 1. The segments 43 in opening or closing motion move in a trajectory parallel to the taper angle of the bore 41. In their open position, the segments 43 allow the part they are designed to shape to pass out of the space they encircle.

Figure 2:
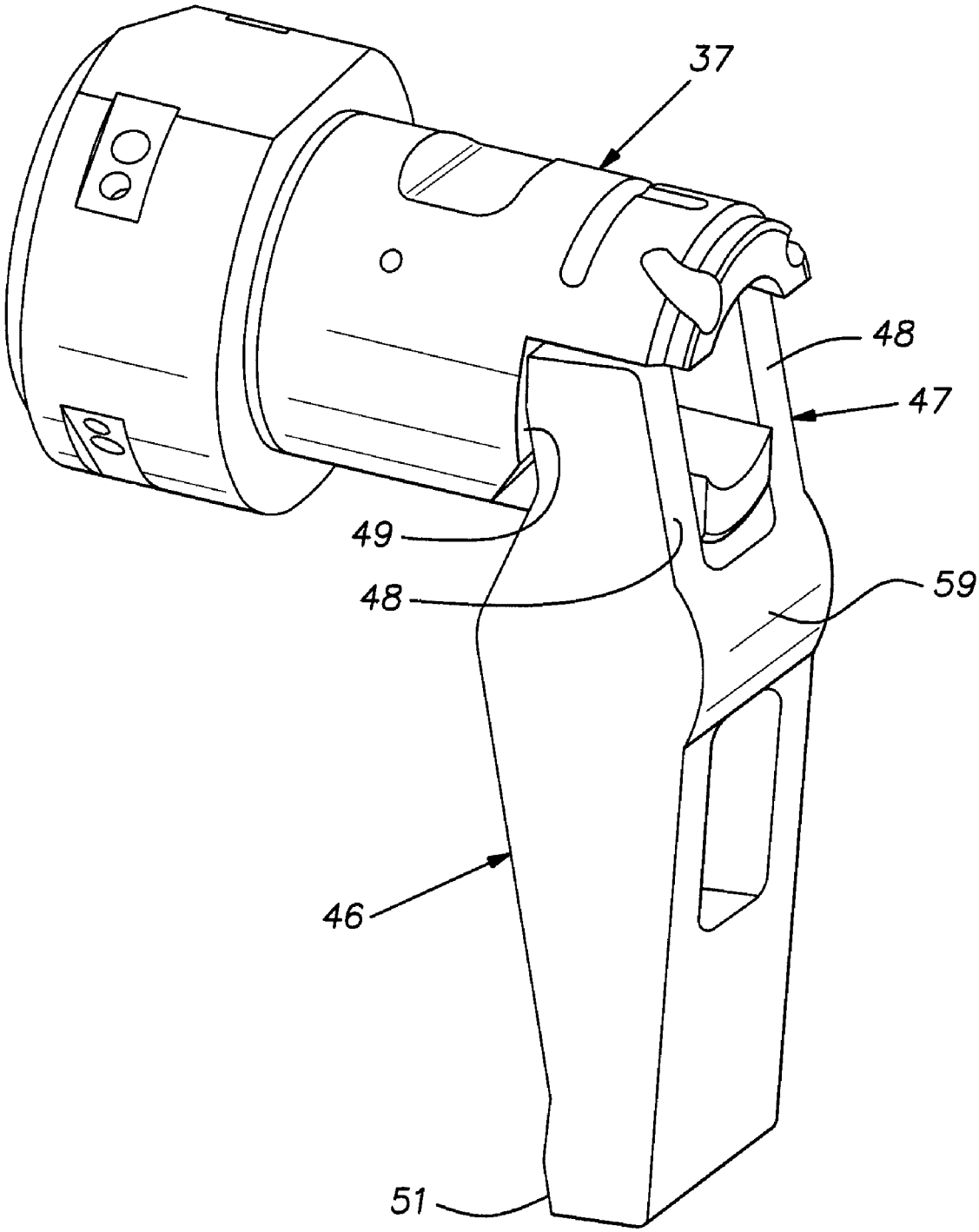
FIG. 2 is an isometric view of a lever and tool case.

A generally vertical pivoted lever 46 has a forked upper end 47 with its tines 48 (FIG. 2) arranged to press against a rear face 49 of the tool case 37. At its lower end 51, the lever 46 is in contact with an end face 52 of a push rod 53. The disclosed push rod 53 is a generally cylindrical body carried in a depending extension 54 of the tool holder 31 and having its axis parallel to the center line 14 of the die and punch. The push rod 53 is supported in a bushing 56 in the extension 54 for reciprocation along its axis. A flat 57 on the side of the rod 53 works with a tangential pin 58 to retain the rod in the bushing while allowing limited axial translation. A spring biased friction shoe (not seen in the view of FIG. 1) radially oriented against the rod 53 provides a friction brake to resist over-travel or extraneous motion of the rod during operation of the machine 10. The lever 46 rocks on a cylindrical surface 59 formed on its upper mid-section. It will be seen that the distance from the center of the cylindrical pivot surface 59, i.e. the origin of a radius describing this surface, to the line of lever contact with the push rod 53, is substantially greater than the distance from this pivot center to the line of contact between the upper end 47 of the lever 46 and the tool case 37 and may, for example, be on the order of a ratio of 2:1.

The push rod 53, as shown in FIG. 1, is interposed between the lower end 51 of the lever 46 and the piston rod 23 of the gas spring 19. More specifically, the push rod 53 is proportioned with respect to the other parts to transmit the force developed by the spring 19 to the lever 46 when the slide 12 is near or at front dead center. At other times in the machine cycle, when the slide 12 withdraws or approaches the die breast 11, but is spaced a distance from the front dead center position, the push rod 53 is not in contact with the piston rod 23 of the spring 19.

It will be understood from the foregoing, that the force of the gas spring 19 is multiplied and transferred to the rear face 49 of the tool case 37 when the slide 12 is near or at front dead center. The result is a forward spring bias on the tool case 37 at or near front dead center of the slide 12. Depending on the configuration of the part 13 before it is formed in the workstation under consideration in FIG. 1, the tool segments 43 can be open or closed during the forward stroke of the slide 12. If the part is not yet bulbous towards the tool or slide side, the segments 43 can be closed. Conversely, if the part 13 is bulbous towards the tool or slide side, the segments 43 must be open to allow insertion of the area of the part to be shaped by the segments 43.

In their open position, the segments 43 are to the left of the position in the tool case 37 shown in FIG. 1. When the slide 12 is cycling through a new forward stroke with the segments 43 open they are caused to slide in the conical bore 34 which cams these elements radially inwardly eventually to their closed position. This closing action of the segments 43 occurs before the slide 12 reaches front dead center. The slide 12 continues its forward motion, and during this time the tool case 37 is strongly biased towards the die 16 by the force of the spring 19 operating through the push rod 53 and lever 46. As the slide 12 continues to move forward toward the front dead center position a forming pin 61 applies a heavy compressive load on the part 13 to upset it radially outwardly to conform to the collective shape of the inner surfaces of the segments 43. This pressure applied to the work piece or part 13 generates high radial forces on the segments 43 which have the effect of applying an axial force urging the tool case 37 rearwardly. The high force of the spring 19 multiplied by the ratio of the lever 46 reliably holds the tool case 37 in position and resists these reactive forces. The spring 19, by way of example, can apply a force of as much as 15,000 lbs. which is in great contrast to prior art mechanical spring arrangements behind a tool case which would be, for example, in the order of 400 or 500 lbs. The high force available from the spring and lever arrangement disclosed herein consistently produces complex parts of high uniform quality without detrimental flashing between the segments 43 or other like defects.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a multi-station forging machine having a stationary die breast and a reciprocating slide moveable in a direction towards and away from the die breast, the slide carrying a tool holder at a workstation, a tool case moveable back and forth on the tool holder in the direction of slide movement, tool segments carried in the tool case and moveable between open and closed positions along respective paths formed by a tapered bore in the tool case, the tapered bore being larger adjacent a front of the tool case and decreasing in size in a direction from the front face, a pivotal lever carried on the slide having one portion engaging a rearwardly facing surface adjacent a rear of the tool case, a pivot surface around which said lever pivots, and another portion on a part of the lever extending from the pivot surface remote from the one portion, a high force spring mounted on the die breast, the spring being arranged to apply a high biasing force to said other lever portion when the slide is near or at front dead center and arranged to avoid applying said high force on said other lever portion when said slide is spaced from said front dead center and adjacent positions, said lever transferring said biasing force to said tool case to bias said tool case forwardly.

2. A forging machine as set forth in claim 1, wherein said high force spring is arranged to apply its force through a push rod carried on said slide to said lever.

3. A forging machine as set forth in claim 2, wherein said push rod is disposed directly vertically below a center line of said workstation.

4. A forging machine as set forth in claim 1, wherein said spring force is borne by said die breast through compressive forces applied by said spring to said die breast.

5. A forging machine as set forth in claim 4, wherein said spring is a gas spring.

6. A forging machine as set forth in claim 5, wherein said gas spring is a liquid cooled unit.

7. A forging machine as set forth in claim 5, wherein said gas spring applies its force to said lever through a push rod.

8. A forging machine as set forth in claim 7, wherein said push rod is arranged in parallel relation to a center line of said workstation.

9. A forging machine as set forth in claim 8, wherein said lever is generally vertically oriented.

* * * * *